US009803583B2

(12) United States Patent
Azevedo

(10) Patent No.: US 9,803,583 B2
(45) Date of Patent: Oct. 31, 2017

(54) DOUBLE WALL SELF-CONTAINED LINER

(71) Applicant: FEDERAL-MOGUL CORPORATION, Southfield, MI (US)

(72) Inventor: Miguel Azevedo, Ann Arbor, MI (US)

(73) Assignee: Federal-Mogul LLC, Southfield, MI (US)

( * ) Notice: Subject to any disclaimer, the term of this patent is extended or adjusted under 35 U.S.C. 154(b) by 237 days.

(21) Appl. No.: 14/661,520

(22) Filed: Mar. 18, 2015

(65) Prior Publication Data

US 2016/0273479 A1 Sep. 22, 2016

(51) Int. Cl.

| | |
|---|---|
| ***F02F 1/16*** | (2006.01) |
| ***F02F 1/00*** | (2006.01) |
| ***F02F 1/10*** | (2006.01) |
| ***F02F 1/24*** | (2006.01) |

(52) U.S. Cl.

CPC ..... *F02F 1/16* (2013.01); *F02F 1/004* (2013.01); *F02F 1/10* (2013.01); *F02F 1/102* (2013.01); *F02F 1/24* (2013.01)

(58) Field of Classification Search

CPC ..... F01P 3/02; F01P 2003/021; F02F 1/004; F02F 1/16

See application file for complete search history.

(56) References Cited

U.S. PATENT DOCUMENTS

| | | | | |
|---|---|---|---|---|
| 1,836,798 | A | 12/1931 | Hefti | |
| 3,481,316 | A | 12/1969 | Olson et al. | |
| 3,942,807 | A * | 3/1976 | Dinger | F02F 11/002 123/41.84 |
| 4,093,842 | A | 6/1978 | Scott | |
| 4,187,767 | A | 2/1980 | Jones, Jr. et al. | |
| 5,062,393 | A | 11/1991 | Smith et al. | |
| 5,083,537 | A | 1/1992 | Onofrio et al. | |

(Continued)

FOREIGN PATENT DOCUMENTS

| | | |
|---|---|---|
| CN | 103628997 A | 3/2014 |
| DE | 3627525 | 2/1988 |

(Continued)

OTHER PUBLICATIONS

International Search Report, mailed May 31, 2016 (PCT/US2016/022530).

*Primary Examiner* — Kevin A Lathers
(74) *Attorney, Agent, or Firm* — Robert L. Stearns; Dickinson Wright, PLLC

(57) ABSTRACT

A robust engine assembly having reduced weight and efficient cooling, without an increase in fuel consumption or carbon dioxide emissions, is provided. The engine assembly includes a double-wall cylinder liner clamped between a cylinder head and a crankcase. A manifold is disposed along a portion of the cylinder liner and includes fluid ports aligned with fluid ports of the cylinder liner to convey cooling fluid to a cooling chamber located between the walls of the cylinder liner. For example, the manifold can be a low-loss hydraulic manifold cast integral with the crankcase. Tie rods connect the cylinder head to the crankcase to clamp the cylinder liner in position. Alternatively, the tie rods can be connected to a main bearing cradle located beneath the crankcase. No attachment features extend into the walls of the cylinder liner, which is especially advantageous when the cylinder liner is formed of aluminum.

20 Claims, 2 Drawing Sheets

(56) References Cited

U.S. PATENT DOCUMENTS

| | | | | |
|---|---|---|---|---|
| 6,116,198 | A * | 9/2000 | Kirtley | F02B 23/0696 123/193.3 |
| 7,162,798 | B2 | 1/2007 | Westra | |
| 7,290,506 | B2 | 11/2007 | Rau, III et al. | |
| 8,096,270 | B2 | 1/2012 | Yamada | |
| 2005/0132996 | A1* | 6/2005 | Sachdev | F02F 7/0031 123/193.3 |
| 2006/0124082 | A1 | 6/2006 | Grunenberg et al. | |
| 2010/0139607 | A1 | 6/2010 | Herbst-Dederichs et al. | |
| 2010/0175641 | A1* | 7/2010 | Yamada | B22D 19/00 123/41.72 |
| 2015/0090215 | A1* | 4/2015 | Boczek | F02F 3/18 123/193.6 |

FOREIGN PATENT DOCUMENTS

| | | | |
|---|---|---|---|
| GB | 2007762 | A | 5/1979 |
| JP | 59101565 | | 6/1984 |
| JP | S6056151 | A | 4/1985 |
| JP | 02241952 | | 9/1990 |
| JP | 02241953 | | 9/1990 |
| JP | 04081552 | | 3/1992 |
| JP | H0578950 | U | 10/1993 |

* cited by examiner

DOUBLE WALL SELF-CONTAINED LINER

BACKGROUND OF THE INVENTION

1. Field of the Invention

This invention relates generally to internal combustion engine assemblies including cylinder liners, and methods of manufacturing the same.

2. Related Art

Manufacturers of internal combustion engines continuously strive to reduce the total weight of the engine, which in turn reduces fuel consumption and carbon dioxide emissions. For example, heavy duty diesel engine blocks formed of compact graphite cast iron have been designed using complex metallurgical casting processes and sophisticated and costly sculpturing of their external walls in order to reduce the total weight of the engine. However, smaller diesel engines shed greater amounts of heat than typical diesel engines. For example, the cooling needs of a typical internal combustion diesel engine amounts to about 20-25% of the heat input given off by the fuel burned, while the smaller engines typically shed even greater amounts of heat, reaching from about 25-30% of the heat input given off by the fuel burned. This amount of lost heat requires even more complex sculpturing of the internal walls of the engine block to convey coolant to the diverse parts of the cylinder liner disposed in the engine block at the appropriate rate.

In addition to the high cost, the complex wall geometry creates stagnation of pockets of fluid, which induces problems with nucleate boiling and cavitation and can be harmful to the engine. These drawbacks can be mitigated by increasing the quantity of the coolant, limiting the heat gradient of the coolant to no more than 8-10° C., and speeding up the flow of the coolant to the extent possible without cavitating the fluid. However, all of these expedients impose increased parasitic pumping losses, which are reflected in an undesirable increase in fuel consumption and carbon dioxide emissions.

SUMMARY OF THE INVENTION

One aspect of the invention comprises a robust engine assembly providing reduced weight with efficient cooling and without the undesirable increase in fuel consumption or carbon dioxide emissions. The engine assembly includes a double-wall cylinder liner clamped between a cylinder head and a crankcase. The cylinder liner includes an outer wall and an inner wall each surrounding a center axis and presenting a cooling chamber therebetween. The outer wall includes at least one liner fluid port for conveying cooling fluid to or from the cooling chamber. A manifold is disposed along a portion of the outer wall between the cylinder head and the crankcase. The manifold includes at least one manifold fluid port aligned with the at least one liner fluid port for conveying the cooling fluid to or from the cooling chamber.

Another aspect of the invention provides a method of manufacturing the engine assembly. The method includes clamping the cylinder liner between the cylinder head and the crankcase. The method further includes disposing the manifold along a portion of the outer wall between the cylinder head and the crankcase, and aligning the at least one manifold fluid port with the at least one liner fluid for conveying the cooling fluid to or from the cooling chamber.

The engine assembly can be used in both gasoline and diesel applications and is capable of achieving numerous advantages over the previously developed designs. The engine assembly is designed so that there is no need for the complex sculptured walls or complex engine block architecture for support or coolant distribution. In fact, the engine block and cooling jacket can be eliminated altogether, as the double-wall cylinder liner can provide the desired cooling path and carry all the clamping and thrust forces. Thus, the total package size, cost, and weight of the engine are reduced. The engine could alternatively be designed with "open block" architecture to reduce dead weight. For example, the assembly can be designed with a simple open block formed of aluminum, without loss of rigidity, as the cylinder liner can be self-supporting as far as pressure loads and stresses.

In addition, the double-wall cylinder liner can be clamped in position between the cylinder head and crankcase without any fastening features extending into the walls of the liner. Instead, tie rods can extend between the cylinder head and crankcase along the outer wall of the cylinder liner. Alternatively, the tie rods can connect the cylinder head and main bearing cradle. This feature is particularly beneficial when the cylinder liner is formed of aluminum, for example an aluminum cylinder liner designed for a diesel engine with high peak firing pressures.

The double-wall construction also provides a greater section modulus and thus more rigid structure for the same load carrying capability. The rigid structure leads to less deformation of the cylinder liner under assembly loads, and thus better oil control, which reduces lubricant oil consumption. The double-wall design also has an inherently greater damping capability than a single-wall liner. The greater damping capability means less vibration at the low frequency spectrum and thus a lower noise footprint.

The manifold and outer wall of the cylinder liner can also be designed with a plurality of fluid ports to control swirling of coolant flow and further improve heat transfer. In addition, the manifold can be designed with a simple low hydraulic loss channel to direct the coolant to or from the cooling chamber. Either bottom-up or top-down (reverse) coolant flows can be implemented. For example, the reverse coolant flow is oftentimes desired in conjunction with highly thermally loaded power units, as it inherently provides for more efficient heat transfer. The low hydraulic loss provides the opportunity for adiabatic applications related to the use of high temperature coolants, such as a sodium-potassium (NaK) alloy or silicon-based coolant formulation, which may prove convenient with combined heat and power concepts. The manifold can also be cast integral with the crankcase, and the need for complex gasket geometries to seal the cylinder liner can be minimized or eliminated. Improved heat transfer without cavitation can also be achieved due to the proximity and stream flow velocity of the coolant.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
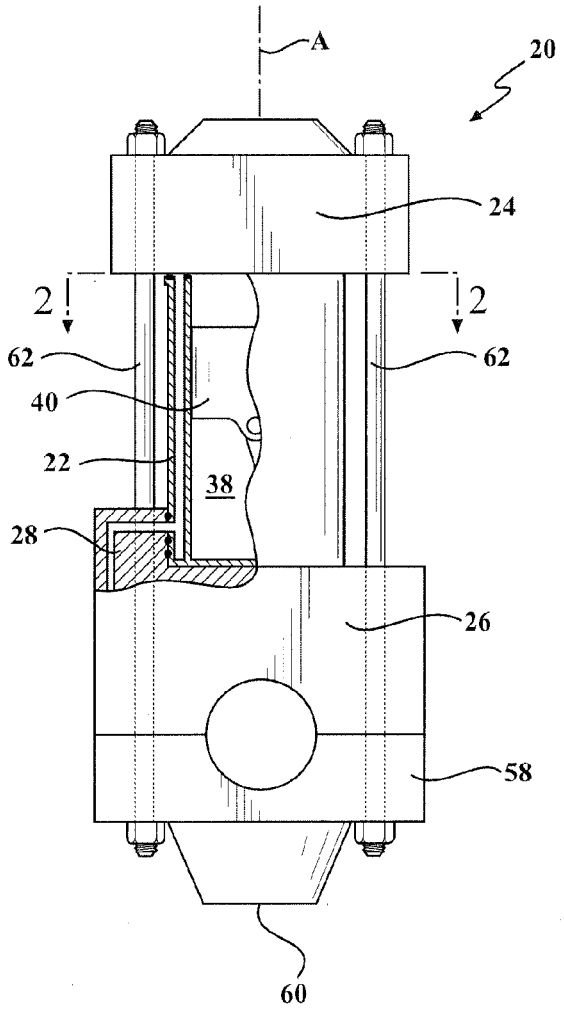
FIG. 1 is a side, partial cross-sectional view of an engine assembly including a double-wall cylinder liner clamped between a cylinder head and crankcase according to an exemplary embodiment.

One aspect of the invention provides a robust engine assembly 20 for a gasoline or diesel internal combustion engine having a reduced total weight and efficient cooling, without an undesirable increase in fuel consumption or carbon dioxide emissions. The engine assembly 20 includes a double-wall cylinder liner 22 clamped between a cylinder head 24 and a crankcase 26. The engine assembly 20 also includes a manifold 28 disposed along a portion of the cylinder liner 22 for conveying cooling fluid 30 to or from the cylinder liner 22.

Figure 2:
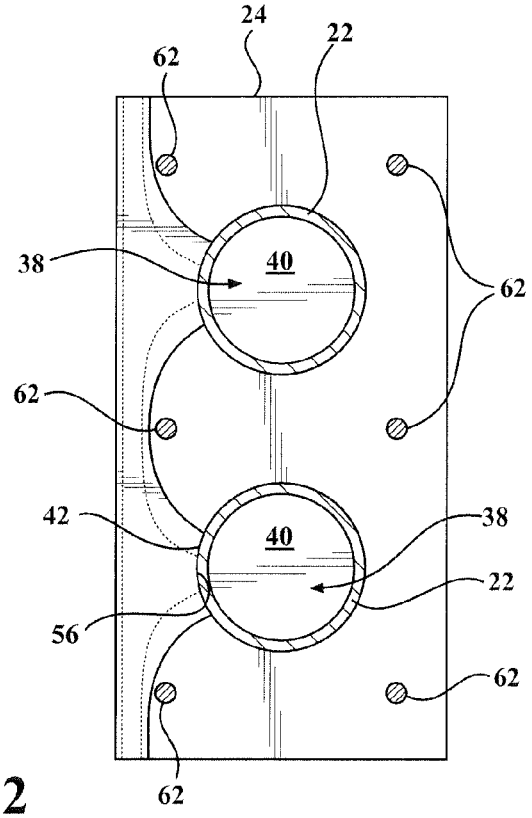
FIG. 2 is a top view of the exemplary engine assembly shown in FIG. 1.
Figure 3:
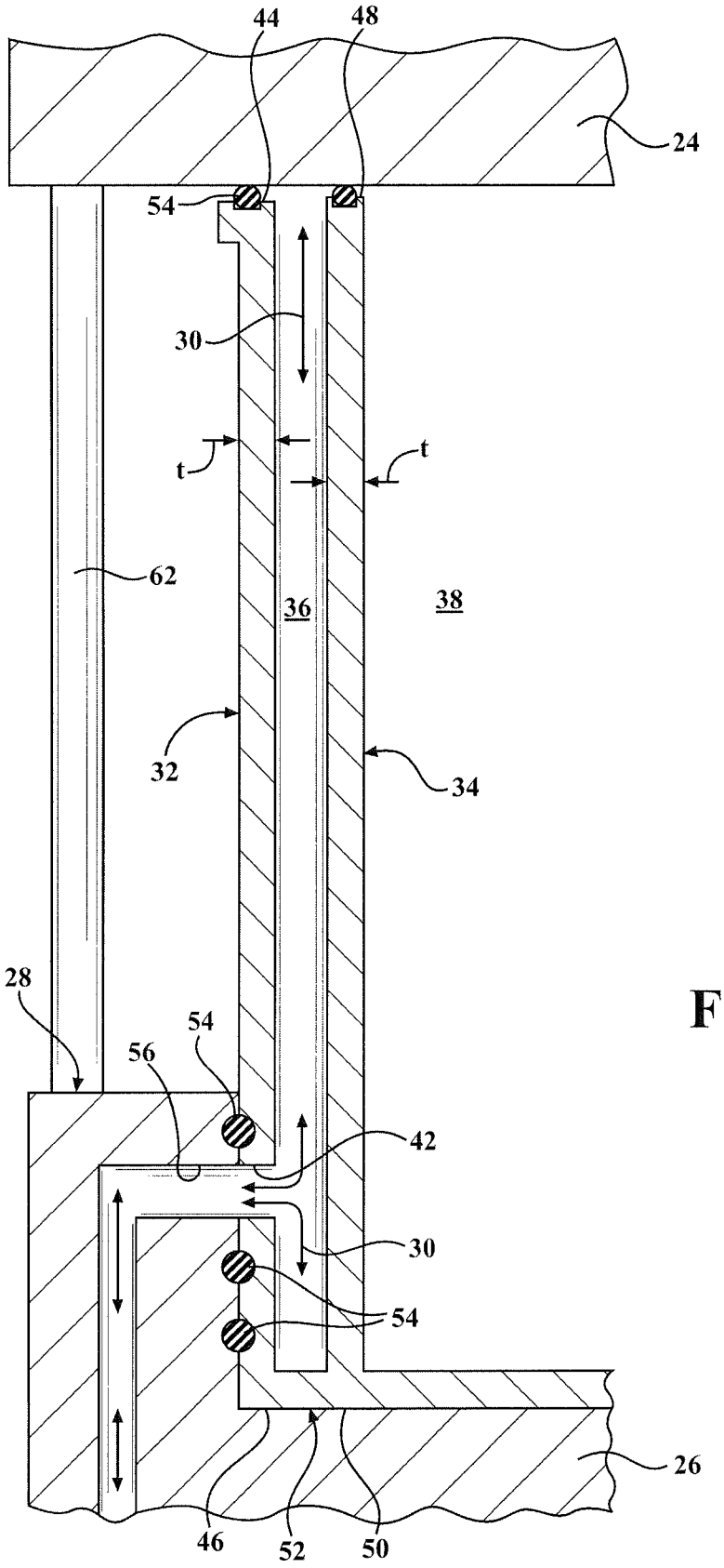
FIG. 3 is a side cross-sectional view of the cylinder liner and surrounding manifold of the exemplary engine assembly shown in FIG. 1.

An exemplary engine assembly 20 including the double-wall cylinder liner 22, cylinder head 24, crankcase 26, and manifold 28 is shown in FIGS. 1-3. As shown, the engine assembly 20 is preferably designed without an engine block or cooling jacket, which significantly reduces the total weight of the engine.

In the exemplary embodiment, the cylinder liner 22 includes an outer wall 32 and an inner wall 34 presenting a cooling chamber 36 therebetween. Both walls 32, 34 surround a center axis A, and the inner wall 34 is disposed between the outer wall 32 and the center axis A. The inner wall 34 of the cylinder liner 22 forms a combustion chamber 38 for receiving a reciprocating piston 40 during use of the engine assembly 20 in an internal combustion engine. The outer wall 32 includes at least one liner fluid port 42, and typically a plurality of the liner fluid ports 42 for conveying cooling fluid 30 to or from the cooling chamber 36. The location and number of liner fluid ports 42 can be designed to control swirling flows and further improve the transfer of heat away from the cylinder liner 22. Furthermore, the design of the engine assembly 20 allows a sodium-potassium alloy (NaK) or a silicon-based oil to be used as the cooling fluid 30.

The cylinder liner 22, as well as the other components of the engine assembly 20, can be formed from an iron-based material or an aluminum-based material. Aluminum-based material is oftentimes preferred to achieve the reduced weight. In the exemplary embodiment, the outer wall 32 of the cylinder liner 22 extends longitudinally along the center axis A from an outer upper end 44 engaging the cylinder head 24 to an outer lower end 46 engaging the crankcase 26. The inner wall 34 of the cylinder liner 22 extends parallel to the outer wall 32 and extends from an inner upper end 48 engaging the cylinder head 24 to an inner lower end 50 engaging the crankcase 26. Each wall 32, 34 presents a thickness t extending between an inner surface facing toward the center axis A and an oppositely facing outer surface. As shown in the Figures, the walls 32, 34 are designed with a simple, flat architecture, rather than a complex design. However, the thickness t of at least one of the walls 32, 34 could vary between the upper end 44, 48 and the lower end 46, 50. In addition, the inner surface of the inner wall 34 can be honed in the usual manner to accommodate piston rings sliding therealong as the piston 40 reciprocates in the combustion chamber 38.

The cylinder liner 22 further includes a base wall 52 connecting the outer lower end 46 to the inner lower end 50. The upper ends 44, 48 of the walls 32, 34 however, present an opening to the cooling chamber 36. In this embodiment, the upper ends 44, 48 of the walls 32, 34 provide a flange supporting a gasket 54. Additional gaskets 54 can be disposed along the walls 32, 34 of the cylinder liner 22, for example near the manifold 28, as shown in FIG. 3. The need for complex gasket geometries however is eliminated due to the simple design of the engine assembly 20.

As shown in FIGS. 1 and 3, the manifold 28 is disposed along the outer wall 32 between the cylinder head 24 and the crankcase 26. The manifold 28 is also formed of an aluminum-based or iron-based material and includes at least one manifold fluid port 56 aligned with the at least one liner fluid port 42 for conveying the cooling fluid 30 to or from the cooling chamber 36. However, as alluded to above, the manifold 28 is preferably designed with a plurality of the manifold fluid ports 56 aligned with the plurality of liner fluid ports 42 to control swirling flows and further improve the transfer of heat away from the cylinder liner 22.

In the exemplary embodiment, the manifold 28 has a cylindrical shape and surrounds only a portion of the outer wall 32 of the cylinder liner 22, so that the majority of the outer wall 32 remains exposed. In this embodiment, the manifold 28 is located adjacent the outer lower end 46 of the cylinder liner 22 and cast integral with the crankcase 26. The manifold 28 is preferably a low-loss hydraulic manifold 28 and carries the cooling fluid 30 to the liner fluid ports 42 located at the bottom of the cylinder liner 22. If reverse cooling is desired, the same manifold 28 can be used to carry the cooling fluid 30 discharged by the liner fluid ports 42 away from the cylinder liner 22.

The cylinder head 24 of the engine assembly 20 is also formed from an aluminum-based material or an iron-based material and rests on the upper ends 44, 48 of the cylinder liner 22. The cylinder head 24 can comprise various different designs, depending on the type of engine used. Likewise, the crankcase 26 is formed from an aluminum-based material or an iron-based material, and can comprise various different designs, depending on the type of engine used.

As shown in FIG. 1, the engine assembly 20 of the exemplary embodiment also includes a main bearing cradle 58 and an oil sump 60. The main bearing cradle 58 is connected to the crankcase 26 opposite the cylinder liner 22, and the oil sump 60 is connected to the main bearing cradle 58 opposite the crankcase 26. The crankcase 26 and main bearing cradle 58 can also be formed from an aluminum-based material or an iron-based material, and can comprise various different designs, depending on the type of engine used.

The exemplary engine assembly 20 further includes a plurality of tie rods 62 connecting the cylinder head 24 to the crankcase 26 to maintain the cylinder liner 22 clamped between the cylinder head 24 and the crankcase 26. As shown in the Figures, the tie rods 62 extend along the cylinder liner 22 and are spaced from the outer surface of the outer wall 32. Thus, no bolts, threads, or other attachment features engage the cylinder liner 22. This is a significant advantage, especially when the cylinder liner 22 is formed of an aluminum-based material. Alternatively, the tie rods 62 can connect the cylinder head 24 to the main bearing cradle 58 to maintain the cylinder liner 22 clamped between the cylinder head 24 and the crankcase 26. In this alternate embodiment, the tie rods 62 are again spaced from the outer wall 32 of the cylinder liner 22 so that no attachment features extend into the walls of the cylinder liner 22.

Another aspect of the invention provides a method for manufacturing the robust and reduced weight engine assembly 20 described above. The method includes clamping the cylinder liner 22 between the cylinder head 24 and the crankcase 26. The method also includes disposing the main bearing cradle 58 along the crankcase 26 opposite the cylinder liner 22, and disposing the oil sump 60 along the main bearing cradle 58 opposite the crankcase 26.

In the exemplary embodiment shown, the method includes connecting the cylinder head 24 to the crankcase 26 with the tie rods 62 to maintain the cylinder liner 22 clamped between the cylinder head 24 and the crankcase 26, such that the tie rods 62 are spaced from the outer wall 32 of the cylinder liner 22. In an alternate embodiment, the method includes connecting the cylinder head 24 to the main bearing cradle 58 with the tie rods 62, so that the tie rods 62 are spaced from the outer wall 32 of the cylinder liner 22. In both cases, no bolts, threads, or other attachment features extend into the walls of the cylinder liner 22.

The method further includes disposing the manifold 28 along only a portion of the outer wall 32 between the cylinder head 24 and the crankcase 26, thus allowing the remainder of the outer wall 32 to be exposed. This step also includes aligning the manifold fluid ports 56 with the liner fluid ports 42 for conveying the cooling fluid 30 to or from the cooling chamber 36 of the cylinder liner 22.

Obviously, many modifications and variations of the present invention are possible in light of the above teachings and may be practiced otherwise than as specifically described while within the scope of the appended claims.

What is claimed is:

1. An engine assembly, comprising:

a cylinder liner clamped between a cylinder head and a crankcase;

said cylinder liner including an outer wall surrounding a center axis and extending longitudinally along said center axis from an outer upper end engaging said cylinder head to an outer lower end engaging said crankcase, an inner wall surrounding said center axis and disposed between said outer wall and said center axis, said inner and outer walls presenting a cooling chamber therebetween, and said outer wall including at least one liner fluid port for conveying cooling fluid to or from said cooling chamber; and a manifold disposed along a portion of said outer wall between said cylinder head and said crankcase, and said manifold including at least one manifold fluid port aligned with said at least one liner fluid port and at least one channel coupled to said at least one manifold fluid port and extending longitudinally past said outer lower end of said outer wall for conveying said cooling fluid to or from said cooling chamber.

2. The assembly of claim 1, wherein said manifold is cast integral with said crankcase and along only a portion of said outer wall for allowing the remainder of said outer wall to be exposed.

3. The assembly of claim 1, wherein said manifold is disposed adjacent said cylinder head and is disposed along only a portion of said outer wall for allowing the remainder of said outer wall to be exposed.

4. The assembly of claim 1 including a plurality of tie rods connecting said cylinder head to said crankcase for maintaining said cylinder liner clamped between said cylinder head and said crankcase, and said tie rods being spaced from said outer wall.

5. The assembly of claim 1 including a main bearing cradle disposed along said crankcase opposite said cylinder liner, a plurality of tie rods connecting said cylinder head to said main bearing cradle for maintaining said cylinder liner clamped between said cylinder head and said crankcase, and said tie rods being spaced from said outer wall of said cylinder liner.

6. The assembly of claim 1 including a main bearing cradle disposed along said crankcase opposite said cylinder liner, and an oil sump connected to said main bearing cradle opposite said crankcase.

7. The assembly of claim 1, wherein each of said walls of said cylinder liner extend longitudinally along said center axis from an upper end to a lower end and present a thickness extending from an inner surface facing said center axis to an oppositely facing outer surface, and said thickness of at least one of said walls varies between said upper end and said lower end.

8. The assembly of claim 1, wherein said cylinder liner is formed from an aluminum-based material.

9. The assembly of claim 1, wherein said cylinder head is formed from an aluminum-based material.

10. The assembly of claim 1, wherein said outer wall of said cylinder liner includes a plurality of said liner fluid ports for conveying the cooling fluid to said cooling chamber, and said manifold includes a plurality of said manifold fluid ports for conveying the cooling fluid to said liner fluid ports.

11. The assembly of claim 1, wherein said inner wall of said cylinder liner extends from an inner upper end engaging said cylinder head to an inner lower end engaging said crankcase;

said cylinder liner includes a base wall connecting said outer lower end of said outer wall to said inner lower end of said inner wall; and said upper ends of said walls present an opening to said cooling chamber.

12. The assembly of claim 1, wherein said walls of said cylinder liner are free of any attachment features extending into said walls.

13. The assembly of claim 1 including a cooling fluid, and wherein said cooling fluid includes a sodium-potassium alloy (NaK).

14. The assembly of claim 1, wherein said cylinder liner is formed from an aluminum-based material or an iron-based material;

said outer wall of said cylinder liner extends longitudinally along said center axis from an outer upper end engaging said cylinder head to an outer lower end engaging said crankcase;

said outer wall of said cylinder liner includes a plurality of said liner fluid ports for conveying cooling fluid to said cooling chamber;

said inner wall of said cylinder liner extends parallel to said outer wall from an inner upper end engaging said cylinder head to an inner lower end engaging said crankcase;

said cylinder liner includes a base wall connecting said outer lower end to said inner lower end;

said upper ends of said walls present an opening to said cooling chamber; said manifold has a cylindrical shape surrounding only a portion of said outer wall adjacent said outer lower end of said cylinder liner for allowing the remainder of said outer wall to be exposed;

said manifold is cast integral with said crankcase; said manifold is a hydraulic manifold formed from an aluminum-based material or an iron-based material; said manifold includes a plurality of said manifold fluid ports for conveying cooling fluid to said liner fluid ports;

said cylinder head is formed from an aluminum-based material or an iron-based material;

said crankcase is formed from an aluminum-based material or an iron-based material; and further including:

a main bearing cradle connected to said crankcase opposite said cylinder liner;

an oil sump connected to said main bearing cradle opposite said crankcase;

a gasket disposed between said upper ends of said cylinder liner and said cylinder head; and a plurality of tie rods connecting said cylinder head to said crankcase for maintaining said cylinder liner clamped between said cylinder head and said crankcase, said tie rods being spaced from said outer surface of said outer wall.

15. A method for manufacturing an engine assembly, comprising the steps of:

clamping a cylinder liner between a cylinder head and a crankcase, the cylinder liner including an outer wall surrounding a center axis and extending longitudinally along the center axis from an outer upper end engaging the cylinder head to an outer lower end engaging the crankcase, an inner wall surrounding the center axis and disposed between the outer wall and the center axis, the inner and outer walls presenting a cooling chamber therebetween, and the outer wall of the cylinder liner including at least one liner fluid port for conveying cooling fluid to or from the cooling chamber; and disposing a manifold having at least one channel extending longitudinally past the outer lower end of the outer wall and coupled to at least one manifold fluid port along a portion of the outer wall between the cylinder head and the crankcase, and aligning the at least one manifold fluid port of the manifold with the at least one liner fluid port for conveying the cooling fluid to or from the liner fluid port.

16. The method of claim 15 including connecting the cylinder head to the crankcase with a plurality of tie rods to maintain the cylinder liner clamped between the cylinder head and the crankcase such that the tie rods are spaced from the outer wall of the cylinder liner.

17. The method of claim 15 including disposing a main bearing cradle along the crankcase such that the main hearing cradle is spaced from the cylinder liner by the crankcase, and connecting the cylinder head to the main bearing cradle with a plurality of tie rods to maintain the cylinder liner clamped between the cylinder head and the crankcase such that the tie rods are spaced from the outer wall of the cylinder liner.

18. The method of claim 15 including disposing a main bearing cradle along the crankcase opposite the cylinder liner, and disposing an oil sump along the main bearing cradle opposite the crankcase.

19. The method of claim 15 including disposing the manifold along only a portion of the outer wall and allowing the remainder of the outer wall to be exposed.

20. The method of claim 15, wherein the cylinder liner is clamped between the cylinder head and the crankcase without any attachment features extending into the walls of the cylinder liner.

* * * * *